US006598910B2

(12) United States Patent
McGregor et al.

(10) Patent No.: US 6,598,910 B2
(45) Date of Patent: Jul. 29, 2003

(54) FRICTION JOINT AND FASTENER INCORPORATING SAME

(75) Inventors: Duncan Duff McGregor, Auckland (NZ); Aaron Goldsbury, Napier (NZ)

(73) Assignee: Interlock Group Limited, Wellington (NZ)

( * ) Notice: Subject to any disclaimer, the term of this patent is extended or adjusted under 35 U.S.C. 154(b) by 0 days.

(21) Appl. No.: 09/765,136

(22) Filed: Jan. 17, 2001

(65) Prior Publication Data

US 2002/0093208 A1 Jul. 18, 2002

(51) Int. Cl.[7] ..... E05C 1/08

(52) U.S. Cl. ..... 292/156; 292/240; 292/147; 292/DIG. 20; 292/DIG. 33; 292/DIG. 47; 292/302

(58) Field of Search ..... 292/139, 140, 292/147, 156, 158, 159, 302, DIG. 20, DIG. 33, DIG. 47, 240; 403/408.1, 368, 367, 366, 365, 353, 345

(56) References Cited

U.S. PATENT DOCUMENTS 4,441,835 A * 4/1984 Davis ..... 403/24
4,489,965 A * 12/1984 Taylor ..... 292/147
4,721,406 A * 1/1988 Davis ..... 16/273
5,620,214 A * 4/1997 Kondratuk ..... 292/217
6,142,541 A * 11/2000 Rotondi ..... 292/241
6,238,127 B1 * 5/2001 Jhumra et al. ..... 403/282
6,347,820 B2 * 2/2002 Subliskey ..... 292/241
6,357,953 B1 * 3/2002 Ballantyne ..... 403/365

* cited by examiner

*Primary Examiner*—Robert J. Sandy
*Assistant Examiner*—Dinesh N Melwani
(74) *Attorney, Agent, or Firm*—Blakely, Sokoloff, Taylor & Zafman

(57) ABSTRACT

A fastener for a closure. The fastener has a friction joint which couples first (10) and second (23) elements such that rotational movement there between can occur. The friction joint has a head fastener (28) and a sleeve (24) to which an end load is applied upon axial movement of the fastening taking place during coupling of the first and second elements (10, 23). This end load causes the sleeve (24) to collapse. The fastener has a wedge element (37) mounted for rectilinear movement in a direction substantially transversed to the axis of rotational movement of the friction joint. A drive arrangement (35) couples the wedge element (37) with the second element (23) such that rotation of the second element (23) is translated into the rectilinear movement of the wedge element (37). A removable handle (44) couples via fingers (49) to second element (23).

10 Claims, 4 Drawing Sheets

FRICTION JOINT AND FASTENER INCORPORATING SAME

This invention relates to a friction joint and to hardware incorporating same.

In building hardware items such as a handle for latching closed a closure, eg a window, it is known to provide some degree of resistance to movement of the handle. This enables the handle to remain, say, in a non-latched position. Without the resistance to movement the handle would tend to fall back to its latched position which is inconvenient to the user who needs to revert the handle to the unlatched position so as to move the closure to a closed position. The handle can also cause damage to surrounding frame, seals and the like in the event that the closure is moved to the closed position without the handle being held in or prior moved to the non-latching position.

This resistance to movement can be achieved by torquing down a threaded element so as to cause some frictional contact between a moving portion of the fastener and some static portion (usually the mounting base of the fastener). A problem with this approach, however, is to achieve uniformity of frictional contact from one handle to the next. For example, while the threaded fastener can be tightened to the same torque level, this predetermined torque level can be achieved because of contact between elements within the pivot joint which, nevertheless, very quickly wear or "settle" thereby resulting in the joint becoming loose. This problem can also arise when the level of frictional contact is achieved by swaging or otherwise deforming the end of a rivet means which is used to combine the joint components together.

Furthermore, variation of friction also occurs over time due to wearing of the contacting components.

The variation that occurs when tightening a rotating assembly to a torque is caused by the fitment of the threaded fastener to its threaded bore. Put simply, the tighter the thread, the less axial load imparted onto the rotating assembly for a given torque.

This common "torque method" is also sensitive to the degree of accuracy that the fastener can be tightened to. For example, when using a pneumatic screwdriver fitted with a spring loaded clutch and common self tapping screws, there is significant variation in the actual tightness from one assembly to the next.

An object of the present invention is therefore to provide an improved friction joint whereby a desired friction level is achieved as a consequence of assembly of elements included in the joint.

In the context of the present invention and the following disclosure the reference to friction is intended to mean that there is a restriction to movement between at least a movable element and a non-movable element such that the friction joint can enable relative movement between the parts to be prevented unless a moving influence is applied.

The friction joint according to the present invention has particular application to a fastener which is useable to latch in a closed position a sliding sash of a window relative to another sliding sash (in a double hung arrangement) or relative to a window frame. However, the friction joint is not limited solely to this application and can be used in connection with latches for latching any closure in a closed position relative to a fixed frame or some other movable element. Thus, the item of hardware can be used for latching a sliding door with a frame or to another door (preferably sliding) member.

Broadly, according to one aspect of the present invention, there is provided a friction joint coupling together first and second elements such that relative rotational movement therebetween can occur, such fastening being achieved by a headed fastening means located through an opening in the second element and engaged with the first element, the head of the fastener means being engageable with an end of a sleeve of the second element, said sleeve being compressible upon an axial tightening movement of the fastening means applying a force to said end of the sleeve.

Preferably a washer means is located between the head of the fastener and the end of the sleeve.

According to a second broad aspect of the invention there is provided a fastener incorporating the friction joint of the first broad aspect including a wedge element mounted for rectilinear movement in a direction substantially transverse to the axis of rotational movement of the friction joint and drive means coupling the wedge element with the second element such that rotation of the second element is translated into said rectilinear movement of the wedge element.

Preferably the fastener includes a bracket with which the wedge element is engageable. The bracket can have a hook shaped projection and the wedge element an inclined portion which is engageable with the hook shaped projection.

In the preferred form an operating lever is coupled to the second element. Preferably the lever is releasably coupled to the second element.

According to one form of the invention there is provided locking means for locking the lever in a position corresponding to the wedge element being engaged with the bracket. The locking means can be mounted by a face plate through which the lever extends to engage with the second element.

Preferably the wedge element is slidingly engaged in a channel formed with the first element. The first element is in one preferred form provided with means for fastening to a fixture.

In the following more detailed description of the invention reference will be made to the accompanying drawings in which.

Figure 1:
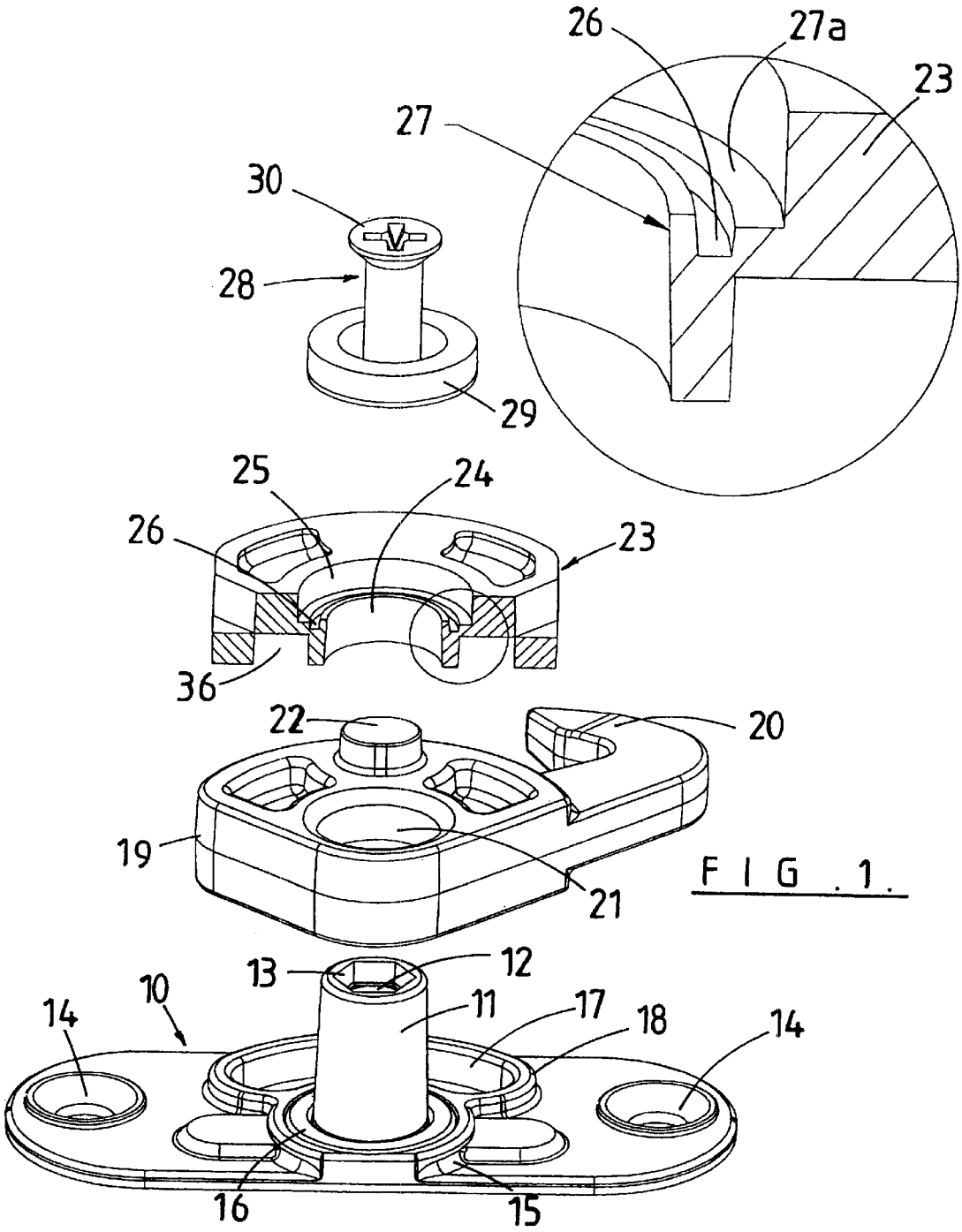
FIG. 1 is an exploded view of an item of hardware in the form of a fastener which incorporates the present invention.
Figure 2A:
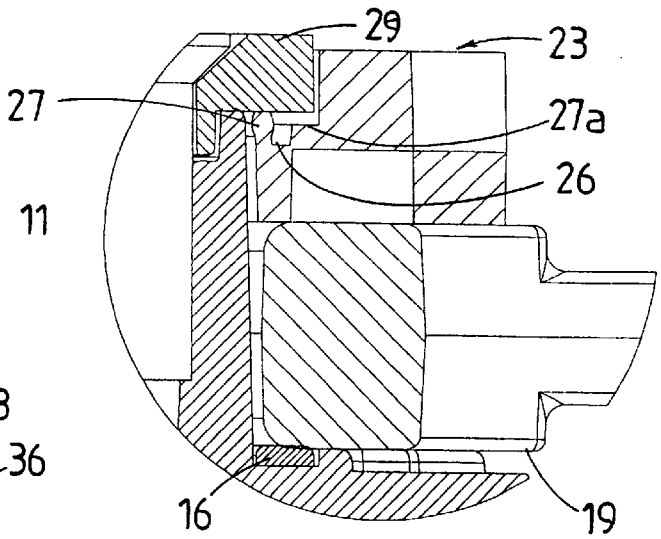
FIG. 2*a* is an enlarged view of a portion of FIG. 2.
Figure 2:
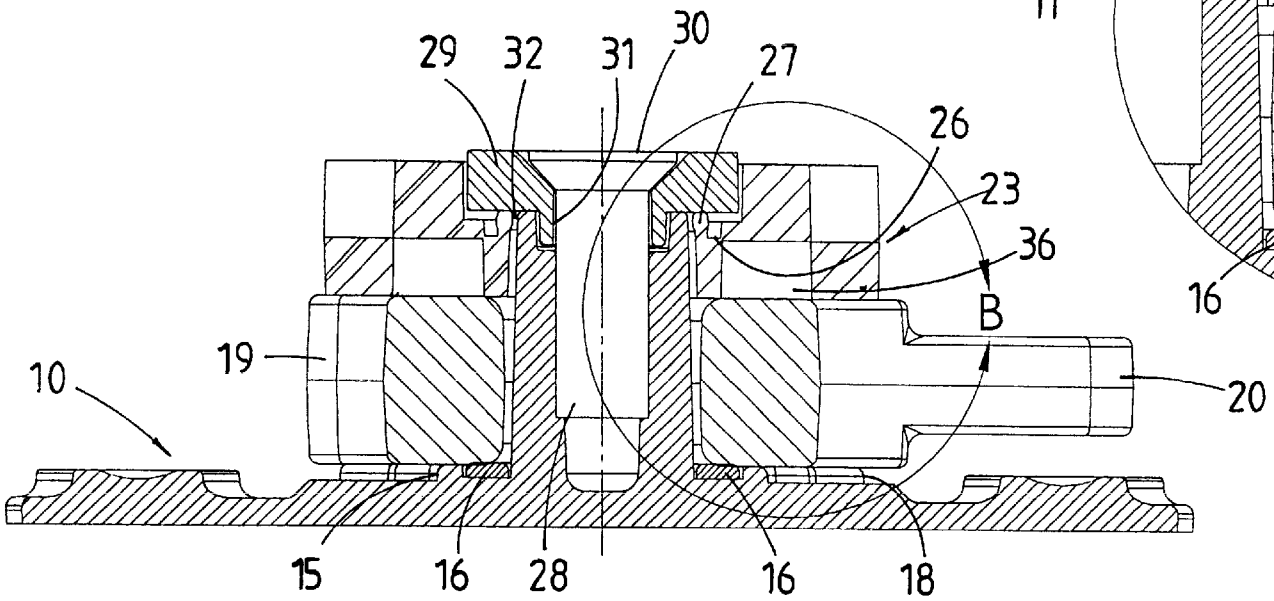
FIG. 2 is a cross-sectional illustration of the assembled arrangement shown in FIG. 1 with the plane of section being through the central axis of the joint and longitudinal relative to the base member of the item of hardware.

To more fully describe the friction joint according to the present invention reference will firstly be made to FIGS. 1, 2 and 2*a* of the drawings.

The item of hardware shown in FIGS. 1 and 2 is a single point fastener for latching in a closed position a closure in a closure frame, eg a window or a door. The hardware fitting includes a base 10 from which projects a spigot 11. The spigot has an internal threaded bore 12 with the outermost end thereof being of angular configuration, ie as is shown in the portion indicated by numeral 13.

The base 10 has apertures 14 for receiving mechanical fasteners which can fasten the base to a suitable structure, eg a door or window frame, a window sash, a door, etc. In a preferred form the base 10 is of zinc die-cast construction.

Located about the base end of the spigot 11 is a circular groove 15 in which is located a wear-resistant washer or bush 16.

Also provided adjacent the base end of the spigot 11 is an arcuate channel, groove, slot or the like, hereinafter "channel 17". In the illustrated form of the invention channel 17, like groove 15, is formed by upstanding wall 18.

A latch body 19 (which can also be zinc die-cast) has a projecting hook shaped latch element 20. Body 19 includes a bore 21 through which the spigot 11 extends when the hardware fitting is assembled. Body 19 can thus rotate about the longitudinal axis of spigot 11.

Projecting from each of opposed flat surfaces of body 19 is a projection 22. One of the projections 22 slidingly engages in channel 17 depending on which way the body 19 is mounted on the base 10. The length of the channel 17 is such that the projection 22 when it comes in contact with respective opposed ends of the channel 17 determines the full latched and full released positions of the hook shaped latch element 20.

A bush or disc element 23 also has a bore 24 within which the distal end of the spigot 11 can engage. The disc element 23 is in the preferred form of the invention formed of a plastics material, eg nylon. As shown in FIG. 2, the underside of the disc 23 engages on the upper flat surface of body 19 in the assembled configuration of the hardware fitting. The projection 22 on this upper flat surface engages in a curved groove 36 in the opposite surface of the disc element 23.

Disc 23 has a counter-bore 25 and in the floor of this is an undercut 26. This undercut effectively forms a sleeve 27. This sleeve 27 is deformable when the joint is assembled as will hereinafter be described.

Also, on the floor of counter-bore 25 adjacent undercut 26 is a relieved surface 27*a* (see detail of FIG. 1 and FIG. 2*a*). This relieved surface 27*a* ensures that when the components are assembled, only the deformable sleeve 27 is in contact with the die-cast washer 29.

The joint is held together in its assembled state by the use of a threaded fastener 28. The threaded shank of the fastener 28 can threadingly engage into threaded bore 12 of spigot 11.

A countersunk washer 29, preferably of zinc die-cast construction separates the head 30 of fastener 28 from the disc 23 and the distal end of the spigot 11. This countersunk washer 29 has an annular wall 31 extending from the underside. Wall 31 has an external cross-sectional configuration commensurate with the shaped end 13 of bore 12 of the spigot 11.

Thus, in the assembled joint the shaped wall 31 locates in shaped portion 13 but due to the angular shape of both elements rotation of the countersunk washer 29 cannot occur. As a consequence, any torque applied by movement of latch body 19 cannot be transferred to the head of the fastener 28. This prevents movement of the latch body 19 imparting a force or torque to the fastener 28 which could otherwise loosen or tighten the fastener.

During assembly of the joint the fastener 28 is tightened down into bore 12. This axial movement of fastener 28 causes the washer 29 to come into contact with the end of sleeve 27. As shown in the enlarged part of FIG. 2, this contact will cause the sleeve 27 to deform by compression. This deforming of the sleeve 27 ensures that the frictional contact within the joint is uniform from one joint to the next.

When assembled the surface of the die-cast washer 29 is in full mating contact with the distal end of spigot 11. The construction is such that the dimension from the under surface of the washer 29 to the top surface of wear resistant washer 16 is less than the combined thickness of the rotating body 19 and the distance from the under surface of the disc element 23 and the top of the sleeve 27. Thus, when washer 29 is driven by the fastener 30 to be in full mating contact with the spigot 11 the sleeve 27 of disc 23 must collapse (as illustrated by FIG. 2*a*) imparting an axial pre-load on the assembly. It is this pre-load which creates the controlled frictional characteristics of the joint.

A hardware fitting of the type shown in FIGS. 1 and 2 can further include a handle portion coupled to body 19 so that the latch body 19 can be rotated about spigot 11.

In the arrangement shown in FIGS. 1 and 2, the movement of the latch body 19 can be controlled by a control link (not shown) which extends to a lock (not shown) but can be of a type similar to that shown in our New Zealand patent specification 301389 or 331673. Unlike the arrangement contemplated in either of the aforesaid patent specifications the control bar can be a flat length having an opening at each end. The opening at one end is shaped to accept a projection 22 (of circular cross-section) and preferably the projection 22 which extends into channel 17. Therefore, the end of the control member will be sandwiched between body 19 and the top of wall 18.

Alternatively and preferably, a groove (not shown) can be provided in the underside of base 10 to enable the control link to slidingly extend into the area of channel 17, the groove extending through the base plate so that the projection 22 can engage in the opening in the control link.

Similarly, the control link can be connected at its other end to a projection of an operating element of the lock. Rather than being fixed to the operating element, the end of the control link can simply be sandwiched in a like manner between the operative element and a surface of the structure with which the lock is mounted. Such an arrangement has the advantage that mechanical fixing of the control link to the lock and the remote latch is not required as the link is simply sandwiched between surfaces between which relative movement can occur.

Figure 3:
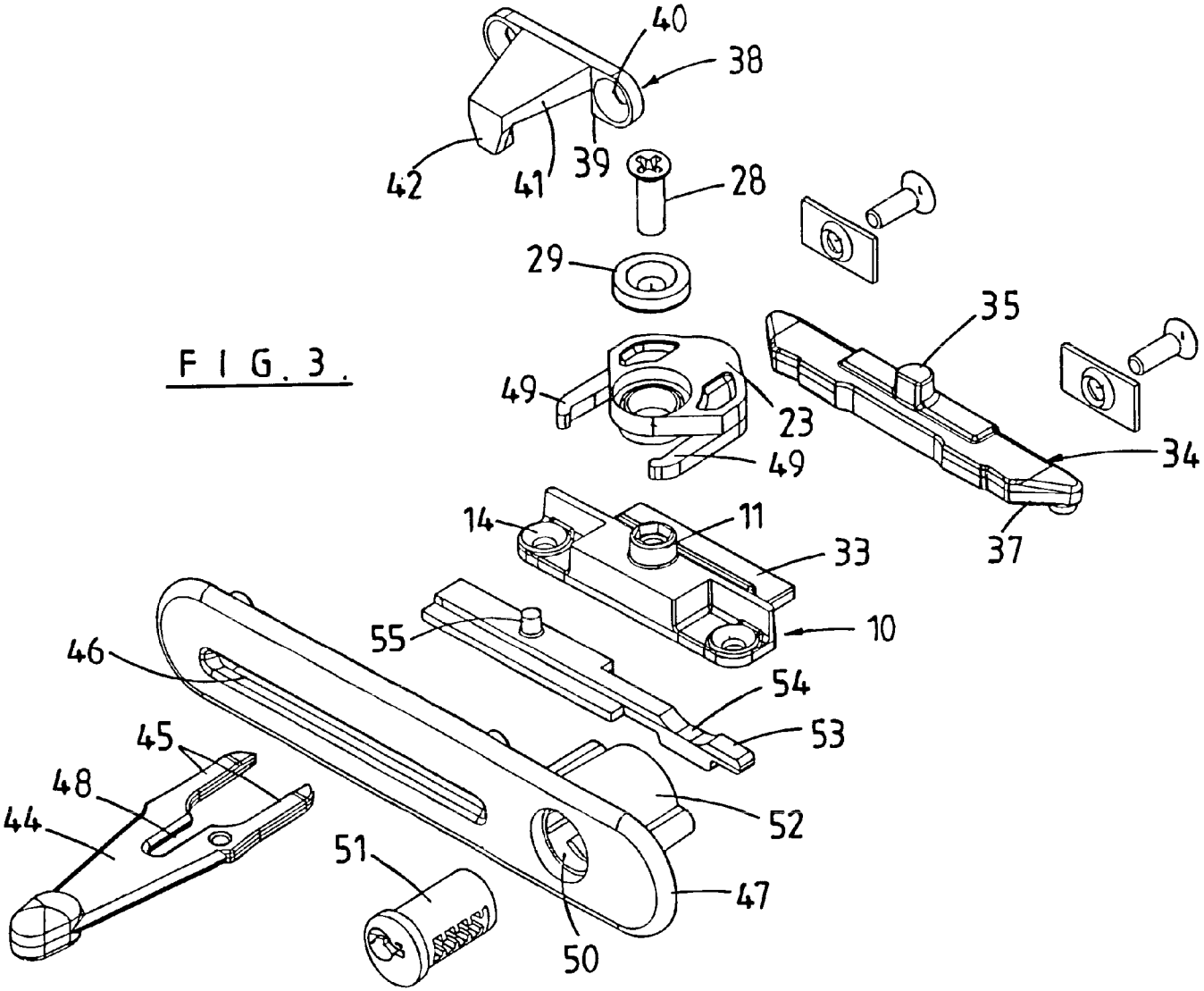
FIG. 3 is an exploded view of a further item of hardware incorporating the present invention.
Figure 5:
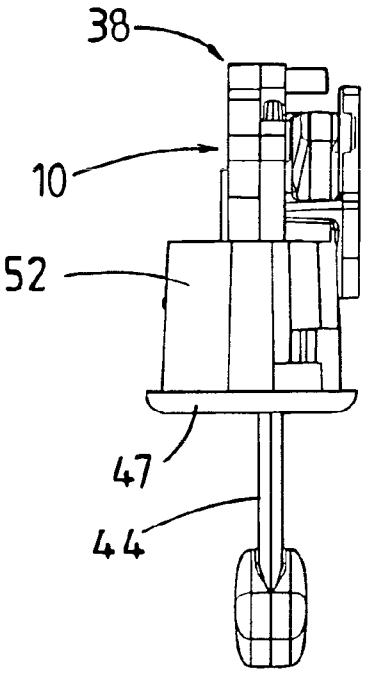
FIG. 5 is an end elevation view of the arrangement shown in FIG. 4.
Figure 4:
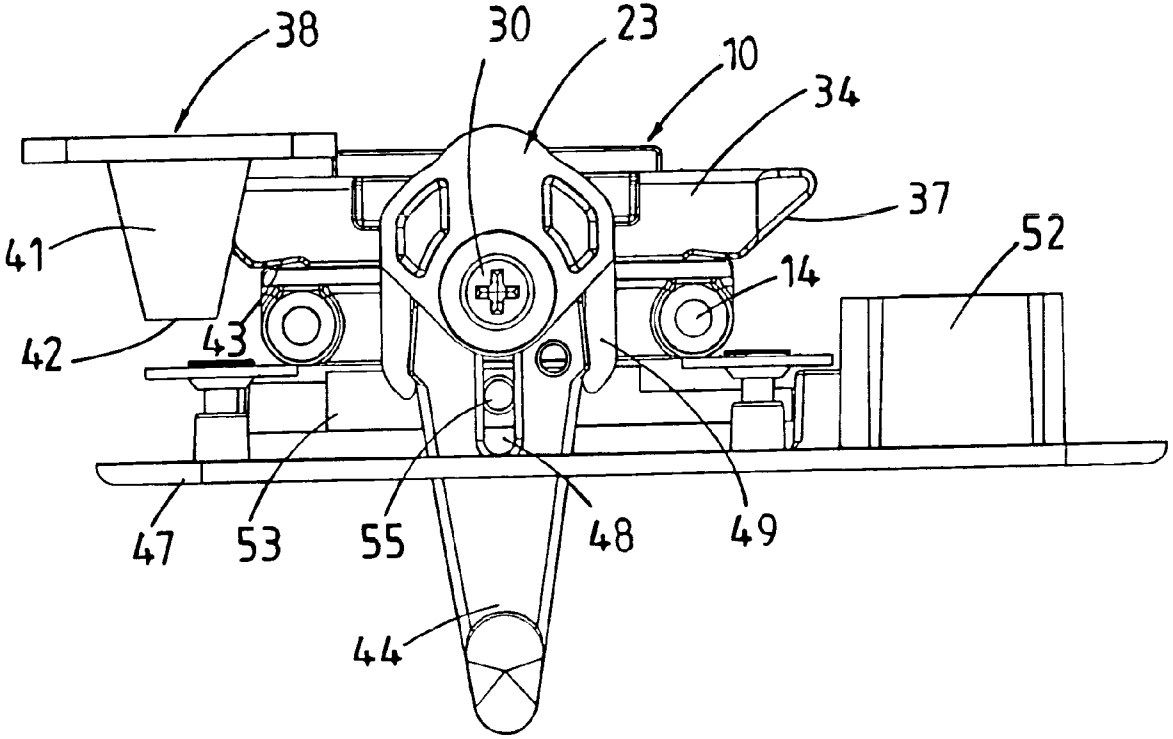
FIG. 4 is a plan assembled view of the arrangement shown in FIG. 3.

The friction joint according to the present invention can be incorporated in other hardware fittings. For example, a further locking arrangement is shown in FIGS. 3 to 5. Elements of the hardware fitting and the pivot joint which are common to those of the fitting and joint of the arrangement shown in FIGS. 1 and 2 carry the same reference numbers.

In the arrangement shown in FIGS. 3–5 the base 10 includes a channel 33 in which is slidingly engaged a wedge element 34. The wedge element 34 has an upstanding lug 35 which slidingly engages in a circular groove 36 (see FIG. 1) in the underside of disc 23. Thus, as the disc 23 is rotated about the central longitudinal axis of spigot 11 a force via lug 35 is applied to wedge 34 to cause it to slide in channel 33.

A ramped end 37 of wedge element 34 can come into engagement with a bracket 38. This bracket 38 has a base 39 with openings 40 whereby it can be fastened to a structure. Extending from the base 39 is an arm 41 with a transverse projection 42.

Therefore, in the latching position the ramp end 37 of the wedge 34 engages behind the transverse projection 42. In the preferred form of the invention the inner side of projection 42 is profiled so that it engages with and rides along ramped end 37 which results in a pull-in action on the bracket 38, ie arm 41 is pulled in a direction transverse to the direction in which wedge element 34 slides. This pull in action can thus compress sealing elements of the window.

In the full latched position the reverse side of transverse projection 42 engages in a shallow recess 43 in the wedge 34. This releases some of the seal compression resulting in an over-locking mechanism.

Rotational movement of the disc 23 is achieved via a locking lever 44. A bifurcated end 45 of lever 44 gages through an elongate slot 46 in a face plate 47. The bifurcated end 45 of lever 44 engages with a pair of opposed fingers 49 of disc 23.

Thus, in one typical arrangement the base 10 is mounted with a window frame while the bracket 38 is mounted with a sash. Installation will generally be within a section of the frame of a typical aluminium, timber or timber clad aluminium window. A bead (eg timber) attached to the base 10 shrouds the device. The face plate 47 is attached to the bead via two screws inserted through the back face of the timber bead.

When the sash moves to the closed position lever 44 can be manipulated to move wedge 34 so that it moves rectilinearly to engage behind transverse projection 42 of the sash bracket 38 so as to latch the window wash in the closed position.

The locking arrangement can also be used with a double hung window where the base plate 10 is mounted with one sliding sash whereas the bracket 38 is mounted with the other sliding sash. The interaction of the wedge 34 with bracket 38 not only prevents relative movement between the sashes from occurring but also the interaction of ramped end 37 and the reverse side of projection 42 causes the sashes to be drawn together which is advantageous in, for example, restricting access through a gap between the sashes for manipulation of the lock to occur in the event of attempted unauthorised entry through the window.

The locking arrangement as shown in FIGS. 3–5 does not need to be of a key lockable configuration. However, as illustrated, an opening 50 can be formed in the face plate 47 through which a conventional lock barrel 51 can be inserted to engage within a lock housing 52. The lock barrel 51 has a scalloped notch which coincides with a square notch in the barrel housing 25. A locking link 53 slides within the square notch in the barrel housing.

The locking lever 44 is inserted through the faceplate 47 allowing the narrow parallel slot 48 to engage wit a circular downward projection 55 of the locking link 53. The two sharp protrusions 45 on the locking lever are inserted into the fingers 49 of disc 23 as described above. The locking link 53 slides within rectangular protrusions on the back of the face plate 47.

The lever 44 is turned towards the lock barrel 51 to latch the device. The parallel slot 48 drives the locking link 53 towards the lock barrel 51. The locking link 53 slides into the square notch in the lock barrel housing 52. In the latched position a circular notch 54 in the locking link 53 is concentric with the lock barrel 51. The key (not shown) when turned rotates the lock barrel 51 and locks the barrel into the circular notch 54 in the locking link 53.

The friction joint of the present invention eliminates torque variation by clamping the assembly to a given distance. The collapsible (deformable) element acts to take up the dimensional variation of the components and impart an axial load. The friction joint of the present invention is thus an improvement over known constructions of friction joints.

What is claimed is:

1. A fastener incorporating a friction joint coupling together first and second elements such that relative rotational movements therebetween can occur, such coupling being achieved by headed fastening means, the friction joint including a sleeve to which an end load is applied upon an axial movement of the fastening means taking place during coupling of the first and second elements, such end load causing the sleeve to collapse, the fastener including a wedge element mounted for rectilinear movement including a wedge element mounted for rectilinear movement in a direction substantial transverse to the axis of rotation of the friction joint and drive means coupling the wedge element with the second element such that rotation of the second element is translated into said rectilinear movement of the wedge element.

2. The fastener as claimed in claim 1 further including a bracket with which the wedge element is engageable.

3. The fastener as claimed in claim 2 wherein the bracket has a hook shaped projection and the wedge element has an inclined portion which is engageable with the hook shaped portion.

4. The fastener as claimed in claim 1 wherein an operating lever is coupled to the second element.

5. The fastener as claimed in claim 4 wherein the lever is releasably coupled to the second element.

6. The fastener as claimed in claim 4 further including locking means for locking the lever in a position corresponding to the wedge element being engaged with the bracket.

7. The fastener as claimed in claim 6 wherein the locking means is mounted by a face plate through which the lever extends to engage with the second element.

8. The fastener as claimed in claim 1 wherein the wedge element is slidingly engaged in a channel formed with the first element.

9. The fastener as claimed in claim 8 wherein the first element incorporates means for fastening to a fixture.

10. The fastener as claimed in claim 1 wherein the wedge element includes a follower which is a slidingly engaged shaped groove in said second element.

* * * * *